US011278144B2

(12) United States Patent
Vernal Silva et al.

(10) Patent No.: US 11,278,144 B2
(45) Date of Patent: Mar. 22, 2022

(54) RECEIVING AND PICK-UP ARRANGEMENT WITH A FOLDABLE HOUSING AND METHOD FOR RECEIVING AND PICKING-UP POSTAL ITEMS

(71) Applicants: Jaime Antonio Vernal Silva, Cologne (DE); Pablo Javier Vernal Munoz, Cologne (DE)

(72) Inventors: Jaime Antonio Vernal Silva, Cologne (DE); Pablo Javier Vernal Munoz, Cologne (DE)

( * ) Notice: Subject to any disclaimer, the term of this patent is extended or adjusted under 35 U.S.C. 154(b) by 44 days.

(21) Appl. No.: 16/866,769

(22) Filed: May 5, 2020

(65) Prior Publication Data

US 2020/0352376 A1 Nov. 12, 2020

(30) Foreign Application Priority Data

May 7, 2019 (DE) ..... 102019111840.9

(51) Int. Cl.
*A47G 29/124* (2006.01)
*A47G 29/12* (2006.01)
(Continued)

(52) U.S. Cl.
CPC ..... *A47G 29/1254* (2017.08); *A47G 29/1218* (2013.01); *A47G 29/141* (2013.01);
(Continued)

(58) Field of Classification Search
CPC ..... A47G 29/1254; A47G 29/1218; A47G 29/124; A47G 29/141; A47G 29/16; A47G 29/20; A47G 2029/144; A47G 2029/145; A47G 2029/148; A47G 2029/147; A47G 2029/149; B65D 7/26; B65D 7/24; B65D 21/086; E05B 65/0075
(Continued)

(56) References Cited

U.S. PATENT DOCUMENTS 1,915,980 A * 6/1933 Craft ..... A47G 29/12 232/19
2,229,646 A * 1/1941 Firestone ..... A47G 29/1223 220/6
(Continued)

FOREIGN PATENT DOCUMENTS

CN 201842317 U 5/2011
CN 107713683 A 2/2018
(Continued)

*Primary Examiner* — William L Miller
(74) *Attorney, Agent, or Firm* — Sughrue Mion, PLLC

(57) ABSTRACT

A receiving and pick-up arrangement for postal items with a foldable housing. When the arrangement is not in use, the housing can be folded up to save space. For this purpose, the side walls are foldable, so that the side walls are arranged or stowed between the top wall and the bottom wall in the folded up state. In the folded up state, the arrangement does not have a receiving chamber for receiving postal items. In operation, the housing is unfolded. In the unfolded state of the housing, the postal item can be placed into the receiving chamber then formed between the side walls via the first opening or the second opening and removed again at a later stage. Also, a method for receiving and a method for picking up a postal item with such an arrangement.

10 Claims, 4 Drawing Sheets

(51) Int. Cl.
*A47G 29/14* (2006.01)
*A47G 29/20* (2006.01)

(52) U.S. Cl.
CPC ..... *A47G 29/20* (2013.01); *A47G 2029/145* (2013.01); *A47G 2029/149* (2013.01)

(58) Field of Classification Search
USPC ..... 232/17, 19, 38, 43.4, 45, 1 E; 220/6; 70/63; 340/569
See application file for complete search history.

(56) References Cited

U.S. PATENT DOCUMENTS 2,456,479 A * 12/1948 Antil ..... A47G 29/14 220/6
6,426,699 B1 * 7/2002 Porter ..... A47F 10/00 221/2
6,540,134 B1 * 4/2003 Rasche ..... A47G 29/14 220/4.28
10,299,617 B1 * 5/2019 Castellanos ..... A47G 29/141
10,321,780 B1 * 6/2019 James ..... A47G 29/141
10,537,196 B1 * 1/2020 MacPherson ..... A47G 29/20
10,743,695 B1 * 8/2020 Altmaier ..... A47G 29/20
10,772,451 B2 * 9/2020 Vernal Silva ..... A47G 29/141
11,087,269 B2 * 8/2021 Newcomb ..... A47G 29/141
2003/0006275 A1 * 1/2003 Gray ..... A47G 29/141 232/19
2016/0068306 A1 * 3/2016 Heinz ..... B65D 81/02 220/560.01
2017/0127868 A1 * 5/2017 Adewuyi ..... A47G 29/141
2017/0188737 A1 * 7/2017 Hippert ..... A47G 29/20
2018/0228310 A1 * 8/2018 Enobakhare ..... A47G 29/1207
2018/0296016 A1 * 10/2018 Teoh ..... A47G 29/20
2019/0180544 A1 * 6/2019 Newcomb ..... E05B 47/0001
2019/0225375 A1 * 7/2019 Sena ..... A47G 29/141
2019/0320836 A1 * 10/2019 Guanch ..... A47G 29/20
2019/0350398 A1 * 11/2019 Raphael ..... A47G 29/141
2020/0107663 A1 * 4/2020 Eivaz ..... A47G 29/20
2020/0380465 A1 * 12/2020 Newcomb ..... A47G 29/141
2020/0397172 A1 * 12/2020 Kennett ..... E05B 65/52
2021/0127880 A1 * 5/2021 Raphael ..... A47G 29/141

FOREIGN PATENT DOCUMENTS

DE 10 2016 113 778 B3 11/2017
JP 4446103 B2 4/2010
WO WO-2015177146 A1 * 11/2015 ..... A47G 29/20

* cited by examiner

RECEIVING AND PICK-UP ARRANGEMENT WITH A FOLDABLE HOUSING AND METHOD FOR RECEIVING AND PICKING-UP POSTAL ITEMS

CROSS REFERENCE TO RELATED APPLICATIONS

This application claims priority to Germany Patent Application No. 10 2019 111 840.9, filed May 7, 2019, the contents of all of which are incorporated herein by reference in their entirety.

BACKGROUND OF THE INVENTION

Field of the Invention

The present invention relates to an arrangement for receiving and picking-up postal items with a housing comprising a top wall, a bottom wall and two side walls, wherein the housing can be folded up and unfolded. In the unfolded state, the two side walls are arranged perpendicular to the top wall and the bottom wall and a receiving chamber for receiving postal items is delimited between the bottom wall, the top wall and the two side walls. In the unfolded state, the housing has a closeable first opening and a closeable second opening through which the postal item can be placed in or removed from the receiving chamber.

Background

JP 4446103 B2 shows a foldable goods delivery container, which enables the receipt of a parcel in the absence of the recipient. The goods delivery container is inserted in a door opening and has a storage opening with an access flap on a corridor side or an outer side. In the unfolded state, the lid of the goods delivery container forms another access flap through which a postal item placed in the receiving chamber can be removed. If no parcel delivery is expected, the housing can be folded up.

The objective of the present invention is to provide a receiving and pick-up arrangement for postal items, which has a more compact installation space and is easier to operate. Furthermore, it is the objective of the present invention to provide an improved method for receiving respectively picking-up of postal items with such a receiving and pick up arrangement.

SUMMARY OF THE INVENTION

According to the invention, the objective is solved for a receiving and pick-up arrangement for postal items in that the receiving and pick-up arrangement comprises: a housing having a top wall, a bottom wall and two side walls, wherein the two side walls are each connected in an articulated manner along a first hinge axis to the top wall and along a second hinge axis to the bottom wall. The two side walls each have at least two side wall parts which are foldable connected to each other along a folding axis. The first hinge axes, the second hinge axes and the folding axes are arranged parallel to each other. This allows the housing to be folded up (collapsed) into a folded state in which the two side walls are folded up between the top wall and the bottom wall, and into an unfolded state in which the two side walls are arranged perpendicular to the top wall and the bottom wall and a receiving chamber for receiving postal items is delimited between the top wall, the bottom wall and the two side walls. In the unfolded state, the housing has a closeable first opening at a first front face and a closeable second opening at a second front face, wherein the first opening is arranged at a first end of the housing and the second opening is arranged at a second end of the housing. The first end and the second end are arranged opposite each other in a direction of the first hinge axes.

An advantage is that the housing can be folded up or collapsed to save space when the receiving and pick-up arrangement is not in use. For this purpose, the two side walls are designed to be foldable, so that the side walls are located respectively stowed away between the top wall and the bottom wall in the folded up state. In the folded up state or collapsed state, the receiving and pick-up arrangement therefore has no receiving chamber to receive postal items. To put the receiving and pick-up arrangement into operation, the housing is unfolded (expanded). In the unfolded state or expanded state of the housing, the postal item can be placed through the first opening or the second opening into the receiving chamber formed between the two side walls and removed again at a later stage. Within the receiving chamber, the postal item can rest at least indirectly on the bottom wall. The receiving and pick-up arrangement could also be called a parcel box.

For instance, the top wall and the bottom wall are arranged parallel to each other. The top wall is a rigid, one-piece wall. The same applies to the bottom wall. Furthermore, in the unfolded state, the top wall and the bottom wall can be aligned horizontally and the two side walls can be aligned vertically. Furthermore, in the folded up state, the side wall parts of the respective side wall can be arranged one above the other. In this way, the side walls are folded up inwards, i.e. into an overlap with the bottom wall and the top wall, further reducing the installation space of the housing in the folded state. For instance, the first opening and the second opening are arranged parallel to each other in the unfolded state.

The unfolded housing may enclose the receiving chamber so that access to the receiving chamber is only possible via the first opening or the second opening. In other words, the receiving chamber can be enclosed by the housing radially to the first hinge axis. The receiving chamber is only accessible via the two axial ends. For this purpose the housing comprises the first opening at the first end and the second opening at the second axial end. This improves burglary protection.

In addition, the receiving and pick-up arrangement can have a holder for attachment to a stationary component. In a mounted state, the receiving and pick-up arrangement is attached to the stationary component. For instance, the stationary component is a vertically upright component, such as a door leaf, for example of an apartment door or house door, a building wall, a window or other part of a building, or a framework, which can be a free-standing framework, or a vertical wall section of a floor-standing enclosing, which can be a free-standing housing and may be placed outside a building. For instance, the holder is located at the first end of the housing. By this, the housing is attached to the stationary component only with one end. Correspondingly, the housing protrudes in the unfolded state from the stationary component along the first hinge axes. For instance, the substantial part of the housing, i.e. more than 75% of the axial extension of the housing along the first hinge axes, can protrude from the stationary component in the mounted state. The stationary component can have a recess which, in the unfolded state of the housing, is aligned with the first opening or can be at least substantially congruent with the first opening. Substantially congruent can mean that the area of the first opening corresponds to at least 80% of the area of the recess.

The holder can be configured to pivot so that the housing can be attached to the stationary component so that it can pivot relative to the stationary component about a pivot axis. For instance, the pivot axis is aligned parallel to the bottom wall and/or the top wall. This allows the housing to be easily pivoted around the pivot axis, especially in the folded up state. For instance, the housing can be pivoted up or down by up to 110° from the horizontal around the pivot axis in the folded up state. Due to the pivotable configuration, the axial installation space of the receiving and pick-up arrangement can be reduced when not in use. In this way, the receiving and pick-up arrangement can be transferred into a space saving rest position when not in use. Referred to the mounted state, the folded up housing or the first hinge axes, respectively, can be aligned vertically, i.e. parallel to the direction of gravity and/or parallel to the stationary component. In contrast, the receiving and pick-up arrangement is in an operating position when the unfolded housing is pivoted by up to 110°, for instance to 90°, about the pivot axis with respect to the rest position. Referred to the mounted state, the top wall and the bottom wall of the unfolded housing can be aligned horizontal, i.e. perpendicular to the direction of gravity and/or perpendicular to the stationary component. Referred to the operating position, the side walls are perpendicular to the bottom wall and the top wall and delimit the receiving chamber. A rotary actuator can be provided that drives the housing to pivot around the pivot axis. The rotary actuator can comprise an electric motor.

For instance, the receiving and pick-up arrangement has an installation frame which can be inserted into a recess or into the recess of the stationary component. The first end of the housing can face the installation frame. In the unfolded state, the first opening of the unfolded housing can overlap with a through-opening defined by the installation frame to define a continuous opening through which the postal items can be placed into the receiving chamber. The first opening of the housing and the through-opening of the installation frame can have same dimensions and/or can be aligned with each other.

For instance, the receiving and pick-up arrangement may have an adjustment device for unfolding and folding up the housing along a vertical axis, wherein the adjustment device adjusts and guides the top wall and/or the bottom wall of the housing from the folded up state to the unfolded state, and vice versa. The adjustment device may also be called a "vertical adjuster". For instance, the top wall and/or the bottom wall is coupled with the first end of the housing to the adjustment device. For instance, the adjustment device can comprise at least one linear drive. By means of the at least one linear drive, the top wall and/or the bottom wall can be adjustable parallel to the vertical axis. The at least one linear actuator can be designed as a spindle drive with a spindle shaft and a spindle nut. Furthermore, the linear drive can comprise electromechanical linear drives, hydraulic or pneumatic cylinders or similar. The adjustment device may have at least one guide element, for instance a guide rod, which extends parallel to the linear drive and at a distance therefrom. For instance, two of the guide elements are provided, by means of which the first end of the top wall and/or the bottom wall is guided along the vertical axis. For instance, the adjustment device is coupled to the top wall in order to adjust and guide the top wall along the vertical axis. For instance, the bottom wall is held stationary relative to the stationary component when the top wall is adjusted. The adjustment device is attachable or attached in the mounted state, respectively, to the installation frame or directly to the stationary component.

Furthermore, the receiving and pick-up arrangement may comprise a deposit belt that delimits the receiving chamber on the bottom side. The deposit belt can extend from the first opening to the second opening in the unfolded state. Therefore, the postal item can rest directly on the deposit belt when placed into the receiving chamber. A belt drive can be provided to drive the deposit belt. In this way, the receiving and pick-up of postal items can be automated. When placing the postal item in the receiving chamber, the postal item is thus placed directly on the deposit belt. When the belt drive is activated, the deposit belt can transport the postal item to the first opening or to the second opening, depending on the selected direction of rotation of the belt drive. A longitudinal direction or conveying direction of the deposit belt can be aligned parallel to the first hinge axes. A further advantage is that the deposit belt is more flexible than a bottom wall usually made of metal, thus reducing the risk of damage to the postal item when it is placed in the receiving chamber.

Furthermore, the receiving and pick-up arrangement may comprise a first device for closing and opening the first opening and/or a second device for closing and opening the second opening. The first device and/or the second device may, for example, each have a roller shutter, a single or multi-part flap which may be hinged bottom sided and/or wall sided, or a single or double-leaf door which may be hinged to the side. In this way, the respective opening can be closed to prevent unauthorized persons from accessing the receiving chamber. For instance, the first opening, which may be an exterior opening, and preferably also the second opening, which may be an interior opening, is designed to be burglar-resistant.

The second device for opening and closing the second opening may have a drive for automatically opening and closing the second opening. In combination with the deposit belt, the postal item placed in the receiving chamber can be automatically ejected through the second opening, for example into an interior of an apartment or a floor-standing housing. By this, the emptied receiving chamber is then again ready for receiving further postal items. Similarly, the first device for opening and closing the first opening may also have a drive for automatically opening and closing the first opening. In this way, the first opening can be automatically opened and closed to allow the receiving of postal items also by unmanned vehicles, for instance flying drones.

Furthermore, the second device for closing and opening the second opening can be located on the housing. For instance, the second device may comprise a roller shutter with a roller shutter curtain and a roller shutter shaft onto which the roller shutter curtain can be rolled up. The roller shutter shaft can be driven by an electric motor. For instance, the roller shutter shaft is located below the bottom wall. Thus, the roller shutter curtain can be moved up starting from the bottom wall to the top wall. This is advantageous especially in the case of automated ejection of the received postal items, where the deposit belt carries the postal items towards the second opening. The upward movement of the roller shutter curtain along the second opening prevents, when the postal item is automatically ejected by the deposit belt, the postal item from being jammed when the second opening is closing or is about to be closed For instance, the shutter shaft is positioned closer to the first end of the housing than to the second end of the housing in order to obtain a more favorable lever arm when the housing is pivotally mounted. The roller shutter curtain may be guided by roller shutter rails which extend along a first section from the roller shutter shaft to the second opening below the bottom wall and along a second section parallel to the second opening. For instance, in the second section, i.e. along the second opening, the roller shutter rails are mounted to the side walls, for instance to the front faces of the side walls. In order to ensure that the side walls can be folded up, the two roller shutter rails in the second section can be formed in multiple parts. For instance, each of the side wall parts can be assigned a single segment of the roller shutter rails, which form continuous roller shutter rails in the unfolded state of the housing.

In order not to hinder the folding process of the housing, the first device for closing and opening the first opening can be structurally separated from the housing, or arranged at a distance, respectively. In the unfolded state, the recess is aligned with the first opening of the housing. For instance, the first device is inserted into the recess, and/or closes and opens the recess of the stationary component. For instance, the first device may have a flap that can be hinged bottom sided, and can be opened and closed automatically or manually. The flap can, for example, be hinged to the installation frame of the receiving and pick-up arrangement, to the holder or directly to the stationary part of the building. In the mounted state, the pivot axis of the flap can be arranged horizontally and can be aligned parallel to the pivot axis of the holder. If the flap is hinged bottom sided, it opens downwards so that the respective flap protrudes outwards when open. The inside surface of the flap can form a deposit area onto which the postal item can be deposited outside the receiving chamber, for example by means of a flying drone. For instance, a receiving container can be arranged on the inside surface of the flap, into which the postal item can be placed when the flap is open. When the flap is closed, the postal item falls into the receiving chamber. The flap can be driven by an electric motor to enable automatic opening and closing.

For instance, the housing can have a base part and an extension part. For instance, the base part comprises the top wall, the bottom wall and the two side walls. The extension part can be moved axially relative to the base part, i.e. parallel to the first hinge axis. By this, the housing can be enlarged or reduced in telescopic manner, thus increasing or decreasing the volume of the recording receiving chamber. For instance, the base part is fixed to the stationary component and the extension part can be held to the stationary component via the base part. Accordingly, the first opening of the housing can be located in the base part and the second opening of the housing in the extension part. The extension part can be moved axially relative to the base part by a displacement device, i.e. parallel to the first hinge axes. The displacement device may also be called an "axial adjuster". The displacement device allows the extension part to be displaced into a first position in which the receiving chamber has a first volume and into at least one second position in which the receiving chamber has a second volume, which is increased relative to the first volume. In this way, the volume of the receiving chamber can be adapted to the size of the postal item, preferably before the first opening or the second opening is opened. For instance, the first volume is at least 10 liters. The second volume can have a maximum of 250 liters. For example, the displacement device can be a linear drive, a spindle drive with an electric motor, or an actuator which could be operated hydraulically, pneumatically or by an electric motor.

The base part can be folded along the first hinge axes, the second hinge axes and the folding axes, just like the housing described above having no possibility of extension (constant volume for the receiving chamber). The extension part can be designed to be foldable, analogous to the base part. The extension part can have a further top wall, a further bottom wall and two further side walls. Correspondingly, the two further side walls are each hinged along a third hinge axis to the further top wall and along a fourth hinge axis to the further bottom wall. The other two side walls each have at least two own side wall parts, which are connected in a foldable manner to each other along another folding axis. The third hinge axes and the fourth hinge axes as well as the other folding axes are aligned parallel to each other and thus also parallel to the first hinge axes, the second hinge axes and the folding axes of the base part. This allows the housing with the base part and the extension part to be folded up and unfolded, respectively. In the folded up state, the two side walls and the two further side walls are folded up between the top wall respectively the further top wall and the bottom wall and the further bottom wall, respectively. For instance, the extension part can be retracted over or into the base part in the folded up state. In the unfolded state, the two side walls are perpendicular to the top wall and the bottom wall and the two further side walls correspondingly are perpendicular to the further top wall and the further bottom wall.

The articulated connections between the respective side wall parts and/or between the respective side walls and the respective top wall or the respective bottom wall, respectively, can easily be provided by joints, hinges, for instance rod hinges, piano hinges, fabric strips.

With regard to the embodiments of the receiving and pick-up arrangement with an unchangeable receiving chamber volume, i.e. the housing has no extension part, the deposit belt can be a circulating closed or ring-shaped drive belt. In principle, however, it is also possible for the deposit belt to have two defined ends, each of which can be rolled up on a respective winding drum to roll up the deposit belt on one or the other winding drum, depending on the direction of conveyance. If the receiving and pick-up arrangement is designed with a variable receiving chamber volume, i.e. the housing has the extension part, the deposit belt can have two defined ends, each of which is rolled up on a respective winding drum, to roll up the deposit belt on one or the other winding drum depending on the direction of conveyance. In this way, the deposit belt can also be adapted to the change in length of the housing along the first hinge axis, which occurs when the extension part is moved axially.

The receiving and pick-up arrangement is suitable for receiving postal items, for instance large-volume items such as small parcels, parcels or similar. Large-volume packages can have minimum dimensions of 200 mm×140 mm×35 mm. In the embodiments of the receiving and pick-up arrangement with a constant receiving chamber volume, i.e. the housing has no extension part, the volume of the receiving chamber can be at least 10 liters and/or can be a maximum of 200 liters. For instance, the constant volume of the receiving chamber is in a range from 10 liters to 150 liters. In embodiments of the receiving and pick-up arrangement with a variable receiving chamber volume, i.e. the housing has the extension part, the first volume of the reception receiving chamber can be at least 10 liters. The second volume of the receiving chamber can be a maximum of 250 liters. In this way, the volume of the receiving chamber can be varied in a range from 10 liters to 250 liters. The first volume is obtained when the extension part is retracted or pushed over or into the base part. The second volume results when the housing has been enlarged by moving the extension part relative to the base part. The first volume can be a minimum volume and the second volume can be a maximum volume, which can be achieved with the receiving and pick-up arrangement depending on the positioning of the extension part relative to the base part. The extension part can overlap the base part at least in sections to ensure that access to the receiving chamber is only possible via the first opening and/or the second opening. Correspondingly, regardless of the position that the extension part can have relative to the base part, the receiving chamber can be enclosed by the housing radially to the first hinge axis.

In order to enable autonomous operation of the receiving and pick-up arrangement, various electronic components, such as control units and sensors, can be provided. For example, a scanner may be provided to read a parcel code or the like. It is also possible to provide a control panel such as a touch display and/or keypad. For instance, the deliverer communicates with the receiving and pick-up arrangement via wireless connection. By this, the deliverer respectively the person picking-up the postal item may enter a code or the like to identify himself as the person authorized to deliver or pick-up the postal items or to identify the postal item itself and/or to open the first opening respectively the exterior opening. The scanner and/or the control panel can be located in front of the first opening and thus outside the receiving chamber. Thus, the receiving and pick-up arrangement can be automated to automatically open the first opening whenever the postal item has been identified and confirmed for receipt by the control unit or when the person authorized to deliver or pick-up the postal item has identified himself. Another electronic component can be a camera that documents the process of receiving and/or removing the postal item for evidence purposes. Recognition software may also be provided to identify the postal item using images supplied by the camera. Furthermore, the camera can be used to improve burglary protection to detect whether there is a person or another object or an object other than the identified postal item inside the receiving chamber. Another electronic component may be a scanner located in the receiving chamber to record the size of the postal item or to read the parcel code, especially the QR code or similar of the postal item. Another electronic component can be a scale in the receiving chamber, which measures the weight of the postal item. The weight of the postal item can be used to identify the postal item. Furthermore, the signals of the scale can be used to detect the receipt or removal of the postal item. Another electronic component can be a data interface with a connection to a network, especially to the world wide web, for example to inform the recipient of the postal item about the receipt of the postal item. Likewise, the data link can be used to inform the deliverer that the postal item has been successfully delivered to the receiving and pick-up arrangement. Analogous, when a postal item previously placed in the receiving and pick-up arrangement is picked-up, the sender and/or the forwarding agent or person authorized to pick-up the postal item can be informed via the data interface that the postal item has been picked up. Another electronic component can be an air conditioning system that conditions the climate of the receiving chamber. For example, a postal item received or to be picked-up may contain goods that need to be cooled, especially perishable goods. This could then be cooled until it is removed from the receiving chamber. It may also be provided that the air conditioning system heats the receiving chamber. For example, a food delivery like a hot pizza could be warmed up in the receiving chamber until it is taken out. Furthermore, the receiving and pick-up arrangement could exceptionally be blocked for the receipt of further postal items until the postal item to be climatized is removed.

A solution of the objective further consists in a method for receiving postal items, for instance large-volume items such as small parcels, parcels or the like, the method comprising the following steps: Providing a receiving and pick-up arrangement as prescribed, wherein the housing is arranged in the folded up state; identifying a postal item located outside the receiving chamber; transferring the housing into the unfolded state; unlocking the first opening after successful identification of the postal item; checking whether the first opening is closed; unlocking the second opening if the first opening is closed; closing the second opening. The inventive method for receiving postal items has the same advantages as the inventive receiving and pick-up arrangement, so that reference is made to the above description in this regard.

After the first opening is unlocked, it can be opened manually or automatically. Afterwards the postal item can be placed into the receiving chamber. If the receiving and pick-up arrangement is designed with the deposit belt and belt drive, the postal item can be automatically ejected out of the receiving chamber through the second opening. In this way, the receiving and pick-up arrangement is after completion of each receiving operation ready again for another receiving or pick-up process. For instance, the receiving and pick-up arrangement is arranged with only a small vertical distance to a stationary underground, for example the corridor of an apartment. For instance, the difference in height between the bottom wall or the deposit belt and the stationary underground may be less than 100 centimeters, for instance less than 50 centimeters. In principle, however, it is also possible that the postal item is manually removed from the receiving chamber through the unlocked second opening. After the postal item has been removed, the housing can be folded up again, especially then when no further postal item is expected. Furthermore, the receiving and pick-up arrangement can be transferred into the rest position.

A solution of the objective further consists in a method for pick-up postal items, for instance large-volume items such as small parcels, parcels or the like, the method comprising the following steps: Providing a receiving and pick-up arrangement as prescribed, wherein the housing is arranged in the folded up state; transferring the housing into the unfolded state; unlocking the second opening; closing the second opening, for instance after the postal item has been placed in the receiving chamber; identifying an authorized person to pick-up postal items located in front of the first opening; unlocking the first opening when the authorized person to pick-up postal items has been successfully identified and the second opening is closed. The inventive method for pick-up postal items has the same advantages as the inventive receiving and pick-up arrangement or the inventive method for receiving postal items, so that reference is made to the above description in this regard.

After the second opening is unlocked, it can be opened manually or automatically. Afterwards, the postal item can be placed in the receiving chamber through the opened second opening. After the postal item to be picked-up has been removed, the receiving and pick-up arrangement is available again for another receiving or pick-up process. In principle, however, it is also possible that the housing remains in the unfolded state after the postal item has been removed from the receiving chamber. This can be advantageous, when another postal item is expected in the near future and the receiving chamber of the receiving and pick-up arrangement does not hinder in the meantime, for example when the recipient is not at home. Otherwise, the receiving and pick-up arrangement can also be transferred into the rest position.

BRIEF DESCRIPTION OF THE DRAWINGS

Preferred embodiments of the invention are shown in the drawings and described below.

DETAILED DESCRIPTION OF THE INVENTION

Figure 1:
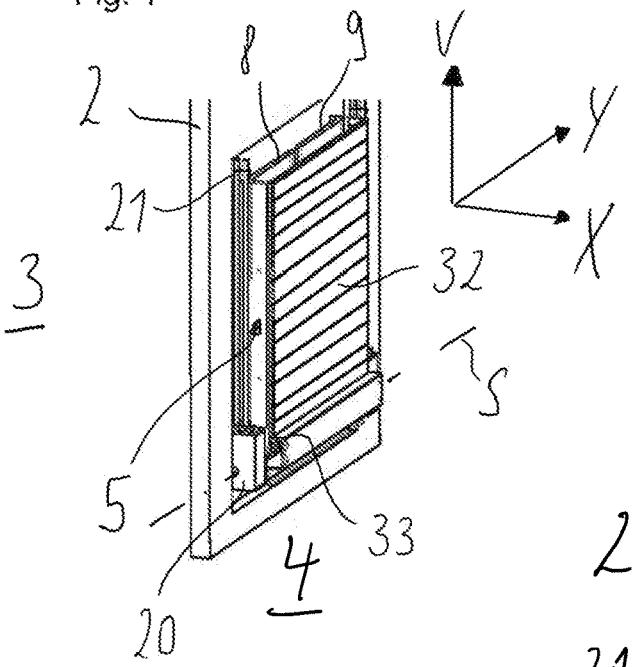
FIG. 1 shows is a perspective view of a receiving and pick-up arrangement according to a first embodiment in a rest position in which a housing of the receiving and pick-up arrangement in the folded up state is pivoted up about a pivot axis.

FIGS. 1 to 8 show a receiving and pick-up arrangement for postal items 40 according to an embodiment of the present invention. The receiving and pick-up arrangement is mounted in a recess 1 of a stationary component 2, here a door leaf of an entrance door to an apartment. In principle, the receiving and pick-up arrangement could also be attached to another stationary component with a recess formed therein, such as a building wall, for instance an interior or exterior wall, a basement wall, a window, a housing wall of a floor-standing housing. The receiving and pick-up arrangement is used, on the one hand, to receive postal items 40 in the absence of the addressee. For this purpose, a deliverer coming from an outside area 3 can place the postal item 40 to be delivered in the receiving and pick-up arrangement. The receiving and pick-up arrangement, as described below, can receive more than one postal items in succession during the absence of the addressee, i.e. without any input of the addressee. Furthermore, a sender, for example the owner of the receiving and pick-up arrangement, can place a postal item from an indoor area 4 into the receiving and pick-up arrangement, the postal item can be removed at a later stage by an authorized person from the outside area 3. After the postal item has been picked-up by the person authorized for pick-up, the receiving and pick-up arrangement is again ready to receipt further postal items without any input by the sender.

A Cartesian coordinate system with the spatial axes X, Y and V is displayed in the figures. The two spatial axes X, Y together form a horizontal plane. The spatial axis V is vertically oriented and is perpendicular to the two spatial axes X and Y.

Figure 2:
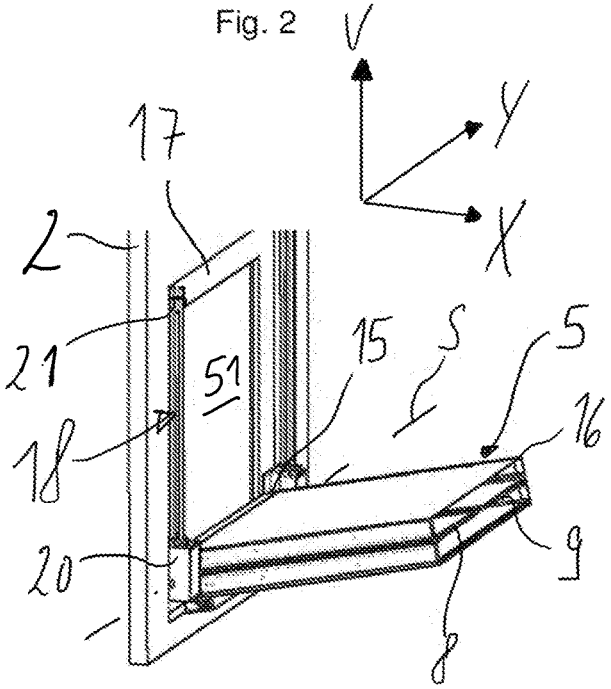
FIG. 2 shows a perspective view of the receiving and pick-up arrangement from FIG. 1 in an intermediate position in which the folded up housing is pivoted downwards.
Figure 3:
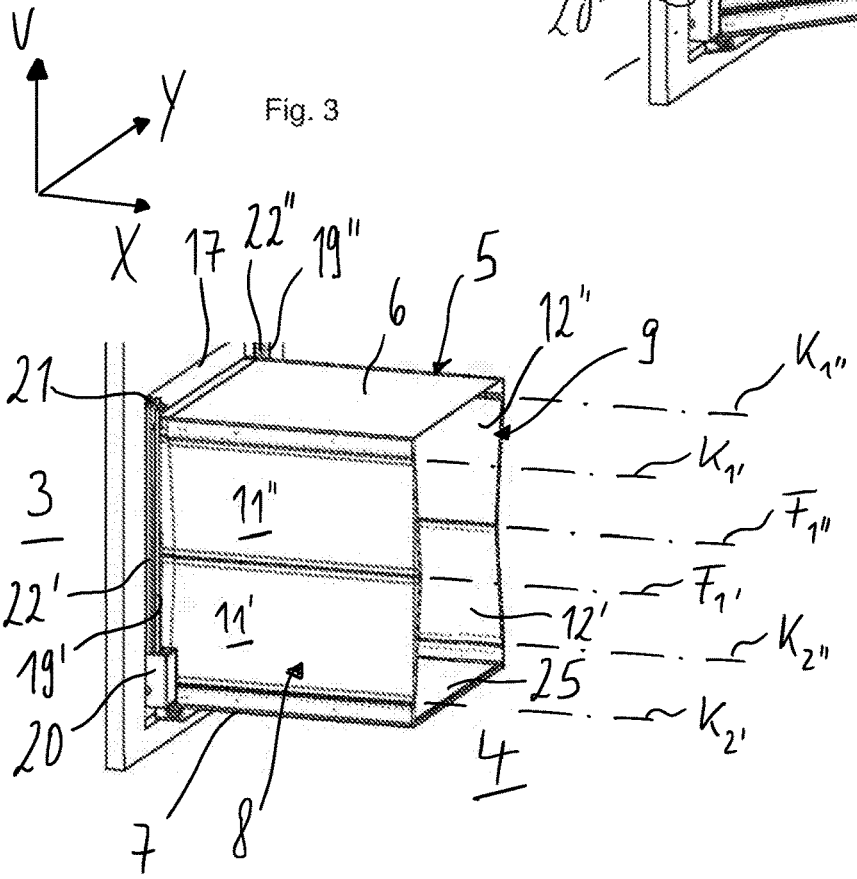
FIG. 3 shows a perspective view of the receiving and pick-up arrangement from FIG. 1 in a further intermediate position, in which the housing pivoted downwards is unfolded.
Figure 5:
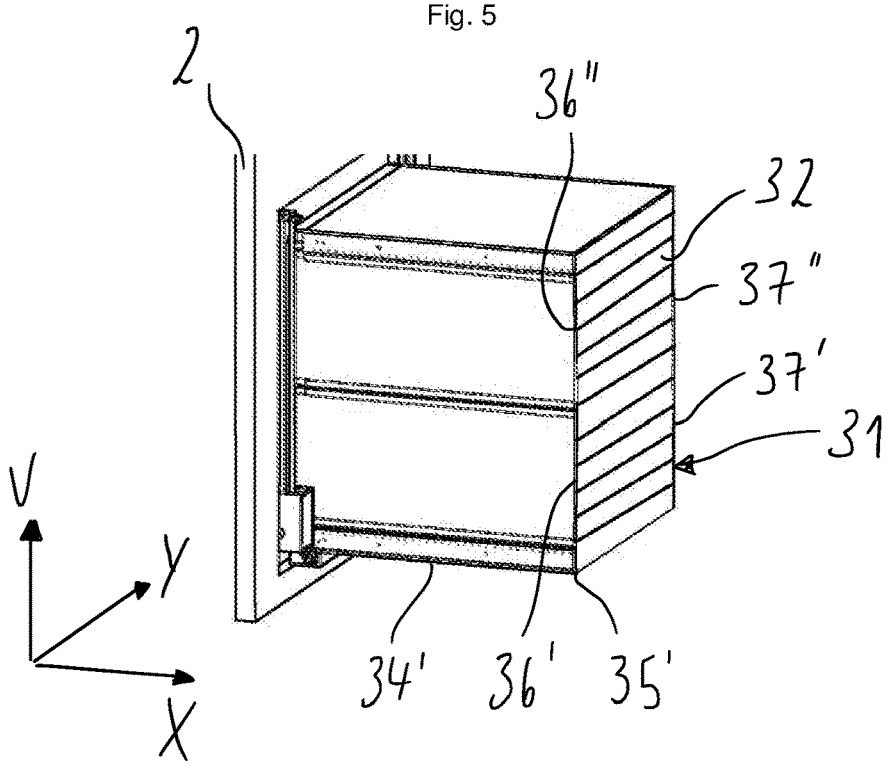
FIG. 5 shows a perspective view of the receiving and pick-up arrangement from FIG. 1 in the operating position, with the second opening of the housing closed.
Figure 6:
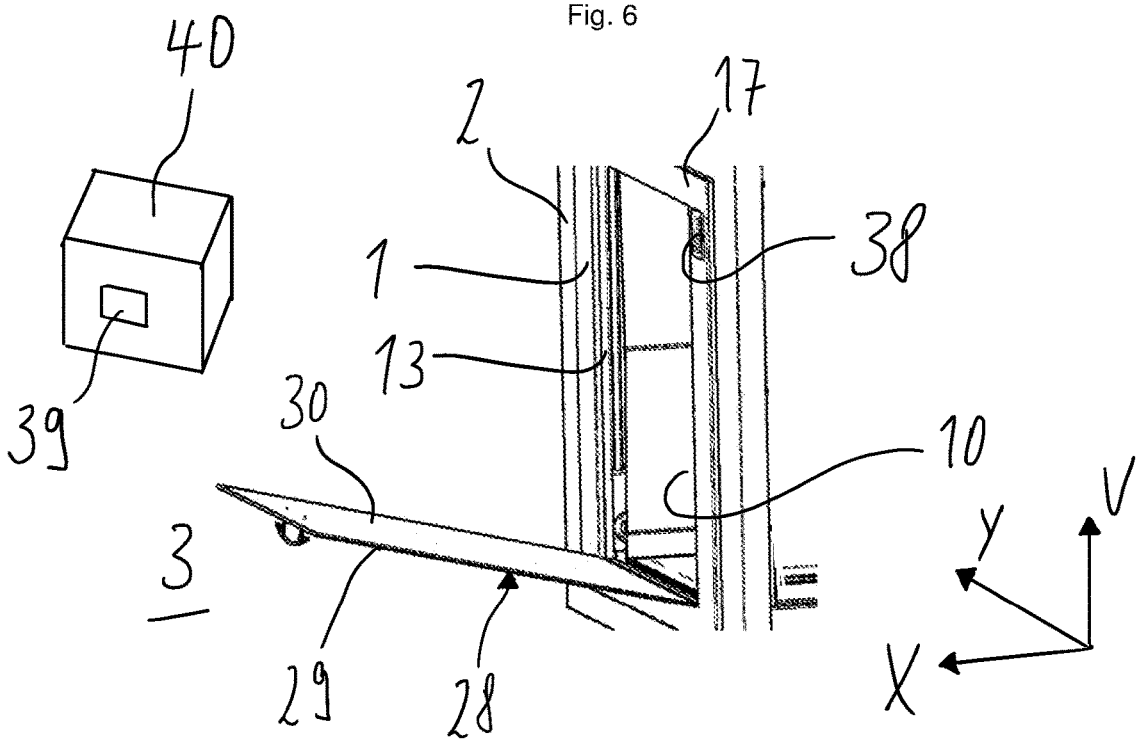
FIG. 6 shows a partial perspective view of the receiving and pick-up arrangement from FIG. 1 in the operating position, with a first opening of the housing opened.
Figure 7:
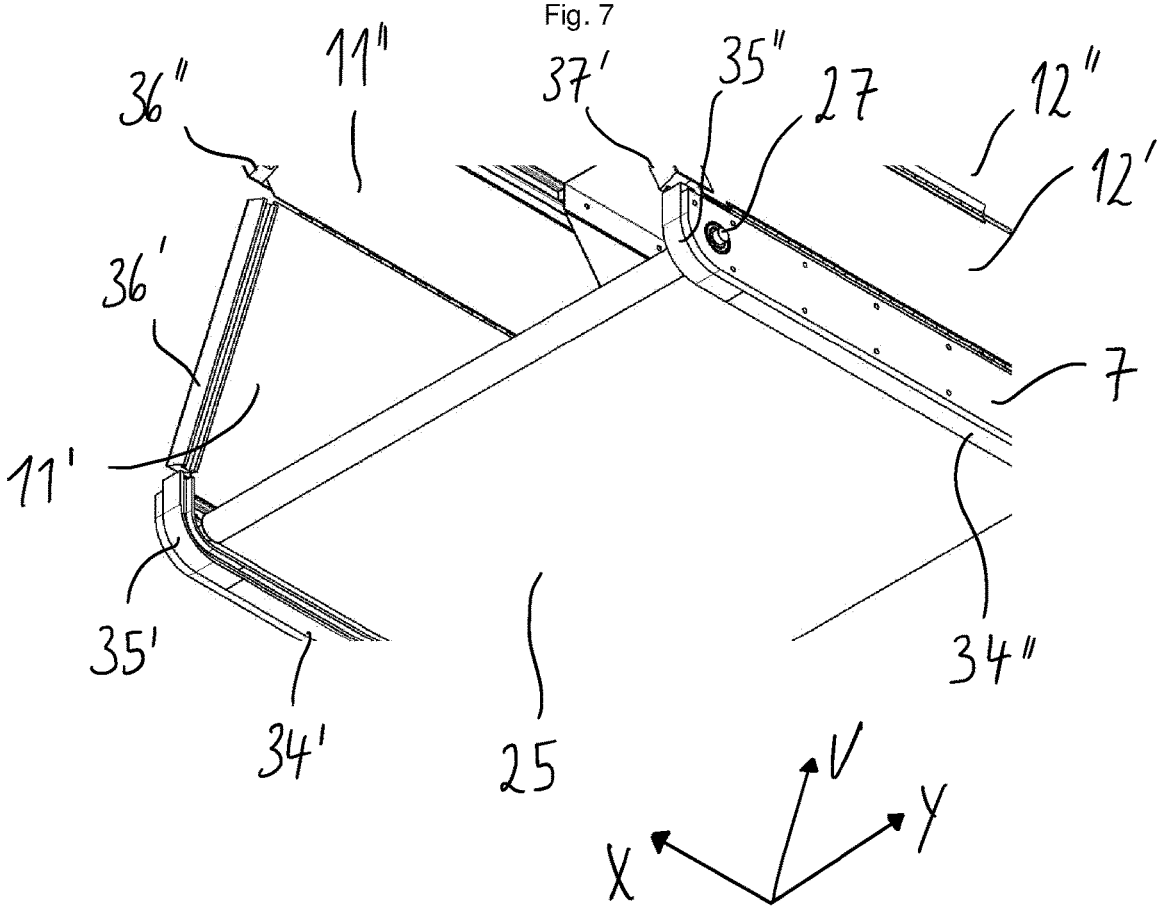
FIG. 7 shows a partial perspective view of the receiving and pick-up arrangement of FIG. 1 from diagonally below, the receiving and pick-up arrangement being shown in an intermediate position between the folded up state and the unfolded state.

The receiving and pick-up arrangement has a housing 5 with a top wall 6, a bottom wall 7 and two side walls 8, 9. The housing 5 is constructed to be foldable. FIGS. 1 and 2 show the casing 5 in a folded up state with the side walls 8, 9 folded between the top wall 6 and the bottom wall 7. FIGS. 4 to 6 and 8 show the housing 5 in an unfolded state in which the two side walls 8, 9 are perpendicular to the top wall 6 and the bottom wall 7 and, together with the top wall 6 and the bottom wall 7, delimit a receiving chamber 10 for the postal items 40. FIGS. 3 and 7 show the housing in an intermediate state which the housing 5 can adopt for a short time when the housing 5 is transferred from the unfolded state into the folded up state, or vice versa.

In order to be able to fold up or unfold the housing 5, the two side walls 8, 9 are each connected in an articulated manner to the top wall 6 along a first hinge axis $K_{1'}$, $K_{1''}$ and along a second hinge axis $K_{2'}$, $K_{2''}$ to the bottom wall 7. The top wall 6 and the bottom wall 7 are arranged parallel to each other. The two side walls 8, 9 each have two side wall parts 11', 11", 12', 12" which are foldable connected to each other along a folding axis $F_{1'}$, $F_{1''}$. The first hinge axes the second hinge axes K2., K2.. and the folding axes $F_{1'}$, $F_{1''}$, which are for the sake of clarity only displayed in FIG. 3, are arranged parallel to each other and each run parallel to the spatial axis X of the Cartesian coordinate system. The housing 5 can be unfolded and folded up along a vertical axis V, which here corresponds to the vertical and is aligned parallel to the spatial axis V of the Cartesian coordinate system. In the folded up state, the side wall parts 11, 12 of the respective side wall 8, 9 are folded between the top wall 6 and the bottom wall 7 and arranged one above the other.

The receiving and pick-up arrangement further comprises an installation frame 17, which is inserted into the recess 1 of the stationary component 2. The installation frame 17 has a central through-opening 51 large enough to pass the postal items 40 through the through-opening 51.

In the unfolded state shown in FIGS. 4 to 6 and 8, the housing 5 has a lockable first opening 13 on a first front face. The first opening 13 is aligned with the recess 1 and the through-opening 51, respectively, and is at least substantially congruent with the through-opening 51. Furthermore, the housing 5 has a second lockable recess 14 on a second front face. Through both the first opening 13 and the second opening 14, the postal item 40 can be placed into or removed from the receiving chamber 10. The first opening 13 is located at a first end 15 of the housing 5, which faces the stationary component 2 and the installation frame 17, respectively. The second opening 14 is located at a second end 16 of the housing 5, the first end 15 and the second end 16 being located opposite each other in a direction of the first hinge axes $K_{1'}$, $K_{1''}$. The two openings 14, 15 are arranged parallel to each other.

An adjustment device 18 is provided for adjusting and guiding the housing 5 from the folded state to the unfolded state, and vice versa. The adjustment device 18 comprises two guide elements, here guide rods 19', 19", which are spaced from each other and arranged laterally next to the recess 1 and extend parallel to the vertical axis V. The guide rods 19', 19" are attached to the installation frame 17 at a lower end via a first support 20 and at an upper end via a second support 21. To adjust the housing 5 from the folded up state to the unfolded state, and vice versa, the top wall 6 is coupled laterally with one linear drive each at the first end 15 of the housing 5, wherein the linear drives, here, are spindle drives 22', 22".

In addition, the receiving and pick-up arrangement has a holder 24 for attachment of the housing 5 to the stationary component 2 pivotable about a pivot axis S. The pivot axis S runs parallel to the spatial axis Y of the Cartesian coordinate system. The holder 24 is attached to the installation frame 17, for instance via the first support 20. The housing 5 is held axially stationary in the direction of the first hinge axes Kin by the pivotable holder 24. Due to the one-sided attachment of the housing 5 with its first end 15 to the stationary component 2, the housing 5 protrudes from the stationary component 2 with its second end 16. The pivot axis S is aligned parallel to the bottom wall 7 and can be aligned perpendicular to the vertical axis V, as shown here. FIG. 1 shows the folded up (collapsed) housing 5 in an upwardly pivoted position, which corresponds to a rest position of the receiving and pick-up arrangement. In contrast, the receiving and pick-up assembly is in an operating position when the housing 5 is unfolded and in the downwardly pivoted position, as shown in FIGS. 4 to 6 and 8.

Furthermore, the receiving and pick-up arrangement has a deposit belt 25. The deposit belt 25 is arranged parallel to the bottom wall 7 and delimits the receiving chamber 10 on the bottom side. When the housing 5 is in the unfolded state, the deposit belt 25 extends between the first opening 13 and the second opening 14. As shown here, the deposit belt 25 can have a closed ring shape, i.e. it can be designed endless. Alternatively, the deposit belt 25 can have two defined ends. Furthermore, a belt drive 26 is provided to drive the deposit belt 25 and guide roller 27 are arranged at both ends 15, 16 of the housing 5 to deflect the endless deposit belt 25.

Furthermore, the receiving and pick-up arrangement has a first device 28 for closing and opening the first opening 13. In detail, the first device 28 has a flap 29 hinged to the bottom of the installation frame 17, as shown in FIG. 6. The flap 29 can be operated manually, although in principle it would also be possible to drive it by an electric motor. The flap 29 closes the recess 1 and the through-opening 51, respectively, which is aligned with the first opening 13 of the housing 5 when the housing 5 is in the unfolded state. On an inner surface 30 of the flap 29 facing the receiving chamber 10 a device (not shown) such as a receptacle, a receiving tray, a basket or the like may be arranged to receive the postal item 40 with the flap 29 opened. In this way, when the flap 29 is closed, the postal item 40 placed on the inner surface 30 or said device, respectively, will automatically fall into the receiving chamber 10 and land on the deposit belt 25. This is particularly advantageous when the postal items 40 are delivered by drones. For instance, the flap 29 can therefore be driven by an electric motor.

Furthermore, the receiving and pick-up arrangement has a second device 31 for closing and opening the second opening 14. The second device 31 has a roller shutter curtain 32. The roller shutter curtain 32 is rolled up at one end onto a roller shutter drum 33 and driven by an electric motor. The roller shutter drum 33 is located below the bottom wall 7 at the first end 15 of the housing 5. The roller shutter curtain 32 is guided in two parallel roller shutter rails, which are divided into multiple sections. Starting with the roller shutter drum 33, a first rail section 34', 34" of the roller shutter rails is attached to the housing 5 from below, as shown in FIG. 7. At the second end 16 of housing 5, a 90° bent transition section 35', 35" is connected, which merges into a second section of the roller shutter rails. In the second section the roller shutter rails are connected to the side walls 8, 9. In detail, a section 36', 36", 37', 37" of the respective roller shutter rail is attached to each of the side wall parts 11', 11", 12', 12", so that the roller shutter rail can be folded together with the side wall parts 11', 11", 12', 12" in the second section. When the housing 5 is in the unfolded state, the individual sections 36', 36", 37', 37" of the roller shutter rails form continuous roller shutter rails in the second section and then extend parallel to the vertical axis V. The roller shutter curtain 32 thus opens the second opening 14 from top to bottom, or closes the second opening 14 from bottom to top.

The receipt of the postal item is explained in the following based on FIGS. 1 to 6 and 8. FIGS. 1 to 6 and 8 show in simplified manner the steps that follow in chronological order when the postal item 40 is received. The process for receiving the postal item is described below, starting with the rest position of the receiving and pick-up arrangement. If the receiving and pick-up arrangement is already in the operating position, the process for receiving the postal item can, in principle, begins with the step shown in FIG. 5.

Figure 4:
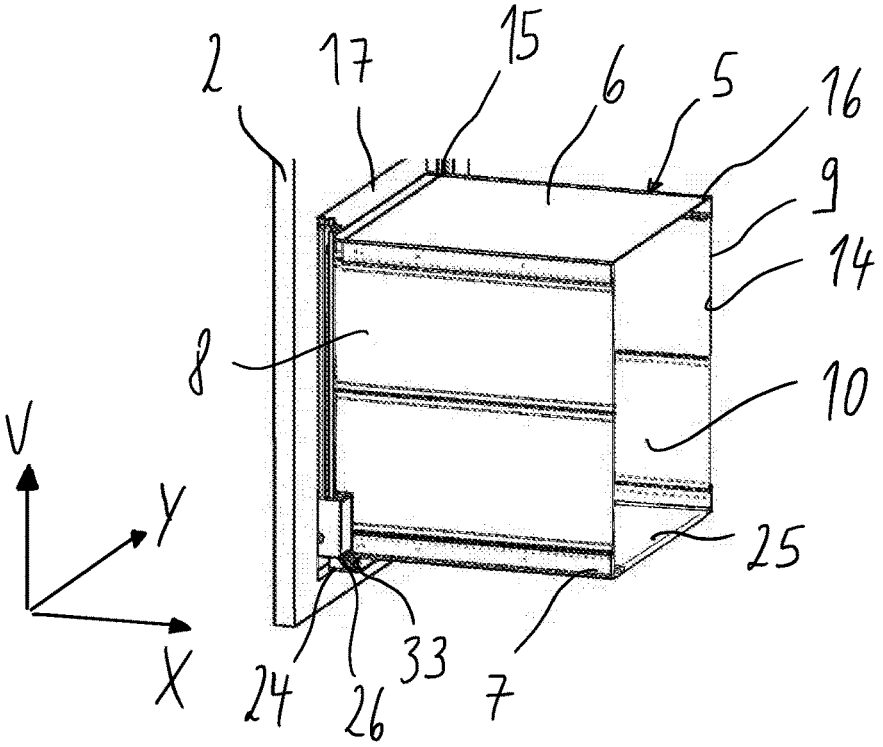
FIG. 4 shows a perspective view of the receiving and pick-up arrangement from FIG. 1 in an operating position, with a second opening of the housing open.

In order to receive the postal item 40, the deliverer first registers the postal item 40 at the receiving and pick-up arrangement. For this purpose, a control panel 38 can be installed in the outside area 3. For example, the deliverer can scan a code 39 on the postal item 40 with a scanner mounted in the outside area 3, the scanner can be integrated in the control panel 38. After successful registration, the housing 5 is first pivoted from the rest position shown in FIG. 1 by 90° about the pivot axis S into a position perpendicular to the installation frame 17 or to the stationary component 2. FIG. 2 shows the folded up housing 5 in an intermediate step, in which the housing 5 has already been pivoted down by about 80°. It can be seen that the first opening 13 is closed by means of the flap 29. The housing 5 is pivoted further into the horizontal position and then unfolded. The base wall 7 is fixed to the installation frame 17 by the pivotable holder 24. The top wall 6 is adjusted upwards along the vertical axis V away from the bottom wall 7 using the adjustment device 18. By adjusting the top wall 6, the side walls 8, 9 which are connected to the top wall 6 and to the bottom wall 7 are unfolded until they are aligned perpendicular to the top wall 6 and bottom wall 7. FIG. 3 shows the housing 5 in a further intermediate step, in which the side wall parts 11', 11", 12', 12" are not yet completely unfolded. The side walls 8, 9 are still slightly folded. Only when the side wall parts 11', 11", 12', 12" of the respective side walls 8, 9 each are in one plane the side walls 8, 9 are unfolded. FIG. 4 shows the housing 5 in the unfolded state. Then the side walls 8, 9 are arranged parallel and opposite to each other and aligned perpendicular to the top wall 6 and the bottom wall 7. In the unfolded state, the receiving chamber 10 is delimited between the side walls 8, 9, the top wall 6 and the bottom wall 7. In FIG. 5 the second opening 14 is closed by the second device 31 for closing and opening the second opening 14. It can be seen that the roller shutter curtain 32 covers the second opening 14. The receiving and pick-up arrangement is now in the operating position.

Figure 8:
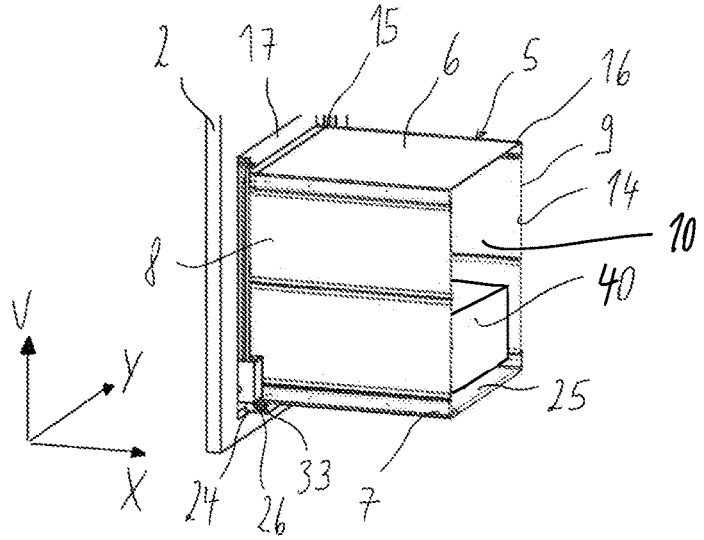
FIG. 8 shows a perspective view of the receiving and pick-up arrangement from FIG. 1 in an operating position, with the second opening of the housing open.

The first opening 13 is then released or unlocked for the deliverer. The flap 29 can be opened manually by the deliverer or, if equipped with an electric motor, automatically. FIG. 6 shows that the deliverer can place the postal item 40 through the opened first opening 13 into the receiving chamber 10 on the deposit belt 25. Afterwards the deliverer can close the flap 29 again, although this could in principle also be done automatically. After the first opening 13 is closed again, the second device 31 for closing and opening the second opening 14 is automatically activated. The roller shutter curtain 32 opens the second opening 14, as shown in FIG. 8. The deposit belt 25 is driven by the belt drive 26 in a conveying direction towards the second opening 14.

The postal item 40 placed on the deposit belt 25 is automatically transported to the second opening 14 and falls through the opened second opening 13 into the inner area 4. Afterwards, the second opening 13 is closed again by the roller shutter curtain 32. Then, the receiving and pick-up arrangement is again in the operating position shown in FIG. 5. In the operating position, the receiving and pick-up arrangement can receive further postal items. On demand, the receiving and pick-up arrangement can also be transferred back into the rest position until the next postal item is received. In principle, however, it is also possible for the receiving and pick-up arrangement to remain in the operating position until the next postal item is received.

The pick-up of the postal item is explained below. The process for pick-up the postal item as described starts with the operating position of the receiving and pick-up arrangement shown in FIG. 5. If, however, the receiving and pick-up assembly is still in the rest position, as shown in FIG. 1, the pick-up process starts with transferring the receiving and pick-up assembly into the operating position by controlling said transfer process via a control panel located in the inner area 4. For instance, the receiving and pick-up arrangement can be integrated in a local network, especially via WLAN. The sender could then control the receiving and pick-up arrangement, for example, via a mobile device such as a smartphone, or via voice instructions Before pick-up of the postal item, the postal item 40 is placed through one of the two openings 13, 14, preferably through the opened second opening 14 into the receiving chamber 10 of the unfolded housing 5. After the postal item 40 is placed within the receiving chamber 10 onto the deposit belt 25, the second opening 14 can be closed automatically or after command by the sender so that the postal item 40 is ready for pick-up, now. The person authorized to pick-up can then register himself at the receiving and pick-up arrangement in the outside area 3. If the registration is successful, the first opening 13 is again unlocked, or can be opened automatically, whereby for burglary-protection, the first opening 13 is only unlocked if the second opening 14 is closed, here by the roller shutter curtain 32. Through the opened first opening 13, the person authorized to pick-up the postal item 40 can remove said postal item 40 from the receiving chamber 10 and then close the first opening 13 again, which could be done manually or automatically. This returns the receiving and pick-up arrangement to the operating position and allows said arrangement to receive further postal items. On demand, the receiving and pick-up arrangement can also be transferred back into the rest position until the next postal item is about to be received. In principle, however, it is also possible for the receiving and pick-up arrangement to remain in the operating position until the next postal item is received.

Figure 9:
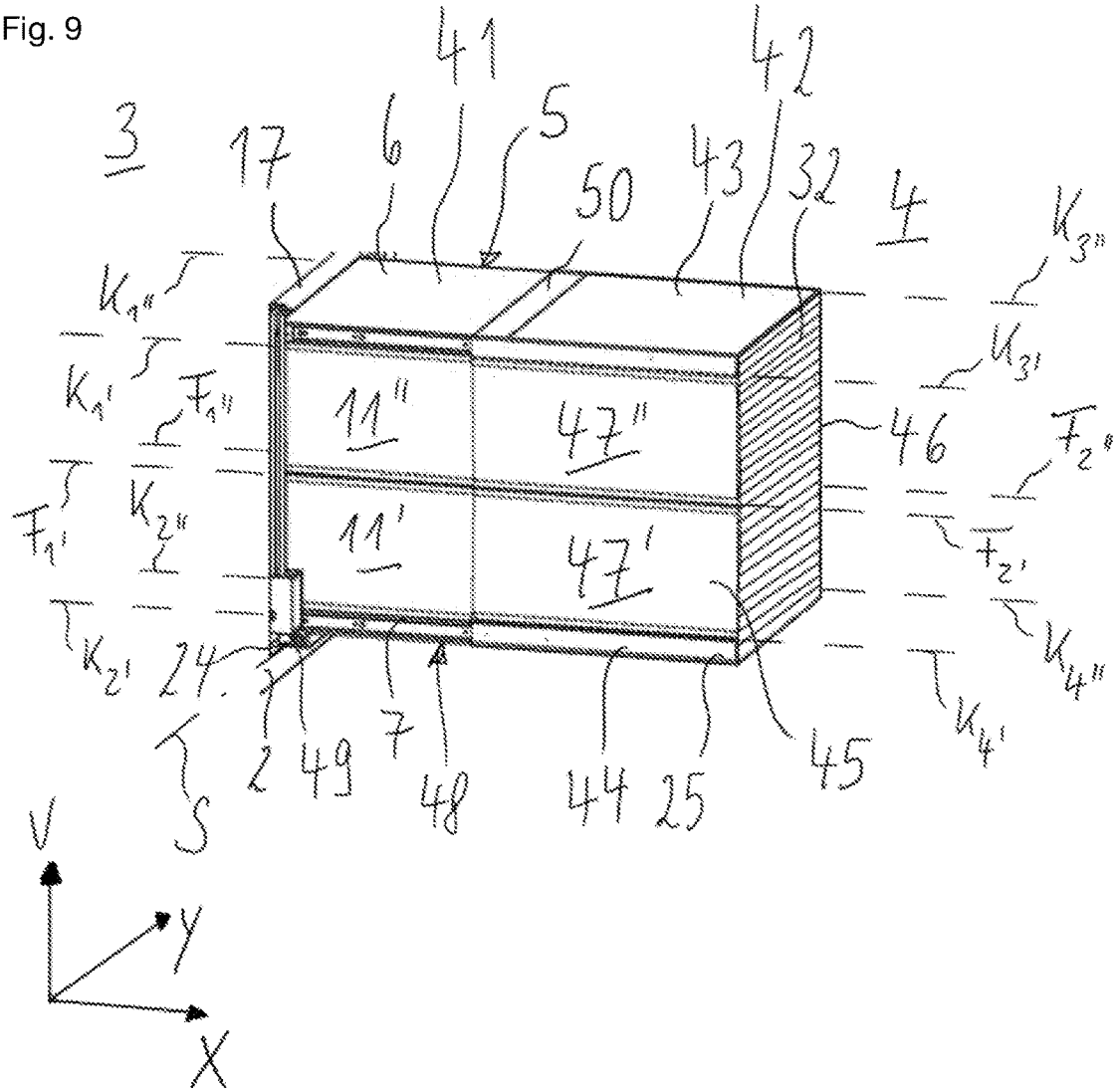
FIG. 9 shows a perspective view of a receiving and pick-up arrangement according to a second embodiment in the operating position.

FIG. 9 shows an inventive receiving and pick-up arrangement for postal items according to a second embodiment of the present invention. Components which are identical to components of the first embodiment described in FIGS. 1 to 8 are marked with the same reference signs. In contrast to the first an embodiment, the receiving and pick-up arrangement as shown in FIG. 9 has a housing that can be adjusted in size.

In detail, the housing 5 comprises a base part 41 and an extension part 42, whereby the extension part 42 is arranged displaceable relative to the base part 41 and parallel to the first hinge axes $K_{1'}$, $K_{1''}$. The base part 41 is held axially stationary on the installation frame 17. The base part 41 comprises the top wall 6, the bottom wall 7 and the two side walls 8, 9. The extension part 42 has a further top wall 43, a further bottom wall 44 and two further side walls 45, 46.

In order to be able to fold up or to unfold the housing 5, both the base part 41 and the extension part 42 are designed to be foldable. For this purpose, the two side walls 8, 9 of the base part 41 are each connected in an articulated manner along one of the first hinge axes $K_{1'}$, $K_{1''}$ to the top wall 6 of the base part 41 and each along one of the second hinge axes $K_{2'}$, $K_{2''}$ to the bottom wall 7 of the base part 41. Furthermore, the two further side walls 45, 46 of the extension part 42 are each connected in an articulated manner along a third hinge axis $K_{3'}$, $K_{3''}$ to the further top wall 43 of the extension part 42 and each along a fourth hinge axis $K4_{4'}$, $K_{4''}$ to the further bottom wall 44 of the extension part 42. The top walls 6, 43 and the bottom walls 7, 44 are arranged parallel to each other. The two side walls 8, 9 of the base part 41 each have the two side wall parts 11', 11", 12', 12", which are each foldable connected to each other along one of the folding axes $F_{1'}$, $F_{1''}$. The two other side walls 45, 46 of the extension part 42 each have two further side wall parts 47', 47", which are foldable connected to each other along a further folding axis. In FIG. 9, because of the perspective view, only the side wall parts 47', 47" of one of the other two side walls 45 are visible. The first hinge axes $K_{1'}$, $K_{1''}$, the second hinge axes $K_{2'}$, $K_{2''}$, the third hinge axes $K_{3'}$, $K_{3''}$ and the fourth hinge axes $K_{4'}$, $K_{4''}$ as well as the folding axes $F_{1'}$, $F_{1''}$ and the further folding axes $F_{2'}$, $F_{2''}$ are aligned parallel to each other and each run parallel to the spatial axis X of the Cartesian coordinate system. The housing 5 can be unfolded and folded up along the vertical axis V, which here corresponds to the vertical and is aligned parallel to the spatial axis V of the Cartesian coordinate system. For this purpose the adjustment device 18 interacts with the top wall 6 of the base part 41. FIG. 9 shows the housing 5 in the unfolded state.

Analogous to the receiving and pick-up arrangement shown in FIGS. 1 to 8 according to a first embodiment of the present invention, the receiving and pick-up arrangement shown in FIG. 8 also has the pivotable holder 24. FIG. 9 shows the receiving and pick-up arrangement in the operating position.

For axial displacement of the extension part 42 relative to the base part 41 held stationary on the installation frame 17, the receiving and pick-up arrangement has a displacement device 48. This allows the extension part 42 to be moved parallel to the first hinge axes $K_{1'}$, $K_{1''}$ into a first position (retracted position), in which the receiving chamber 10 has a first volume, and into at least one second position (extended position), in which the receiving chamber 10 has a second volume increased relative to the first volume. For instance, said adjustment is infinitely variable. FIG. 8 shows that the extension part 42 even in the extended state overlaps at least in a section 50 the base part 41. For example, the displacement device 48 may have a linear drive acting in the direction of the first hinge axes $K_{1'}$, $K_{1''}$. The linear drive can be a spindle drive with an electric motor. A spindle shaft of the spindle drive can be supported on the holder 24 and a spindle nut running on a spindle shaft can be firmly connected to the extension part 42. Likewise, the displacement device 48 could also have an actuator which could be operated hydraulically or by an electric motor. In this way, the volume of the receiving chamber 10 can be adjusted to the size of the postal item 40 before the postal item is received by axially moving the extension part 42 relative to the base part 41.

The deposit belt 25 has a finite design and thus has two defined ends, each of which is rolled up on its own winding drum 49 in order to roll up the deposit belt 25 on one or the other winding drum 49, depending on the direction of conveyance. In this way the deposit belt 25, which delimits the receiving chamber 10 at the bottom, can react to the change in length of the housing 5 along the first hinge axis $K_{1'}$, $K_{1''}$, which results from the axial displacement of the extension part 42, and can be rolled up when the volume of the receiving chamber 10 is reduced or unrolled when the volume of the receiving chamber 10 is increased.

LIST OF REFERENCE SIGNS

1 Recess
2 stationary component
3 outside area
4 inside area
5 housing
6 top wall
7 bottom wall
8 side wall
9 side wall
10 receiving chamber
11 side wall part
12 side wall part
13 opening
14 opening
15 end
16 end
17 installation frame
18 adjustment device
19 guide rod
20 support
21 support
22 spindle drive
23 spindle drive
24 holder
25 deposit belt
26 belt drive
27 guide roll
28 device for closing and opening the first opening
29 flap
30 inner surface
31 device for closing and opening the second opening
32 roller shutter curtain
33 roller shutter drum
34 rail section
35 transition section
36 section
37 section
38 control panel
39 code
40 postal item
41 base part
42 extension part
43 top wall
44 bottom wall
45 side wall
46 side wall
47 side wall part
48 displacement device
49 winding drum
50 section
51 through-opening
V vertical axis or vertical
K hinge axis
F folding axis
S pivot axis

The invention claimed is:

1. A receiving and pick-up arrangement for postal items with a housing comprising a top wall, a bottom wall and two side walls, wherein the two side walls are each connected in an articulated manner along a first hinge axis to the top wall and along a second hinge axis to the bottom wall, and wherein the two side walls each comprise at least two side wall parts, which are foldable connected to one another along a folding axis, wherein the first hinge axes, the second hinge axes, and the folding axes are arranged parallel to one another, so that the housing is foldable into a folded up state, in which the two side walls are folded up between the top wall and the bottom wall, and into an unfolded state, in which the two side walls are arranged perpendicular to the top wall and the bottom wall and a receiving chamber for receiving the postal items is delimited between the top wall, the bottom wall and the two side walls, wherein the housing has in the unfolded state a closeable first opening at a first front face and a closeable second opening at a second front face, wherein the first opening is arranged at a first end of the housing and the second opening is arranged at a second end of the housing, wherein the first end and the second end are arranged opposite one another in a direction of the first hinge axes, and a holder for pivotally mounting the housing on a stationary component about a pivot axis, wherein the pivot axis is arranged parallel to the bottom wall and at the first end of the housing.

2. The receiving and pick-up arrangement according to claim 1, wherein the receiving and pick-up arrangement comprises an installation frame for insertion in a recess of the stationary component, wherein the first end of the housing faces the installation frame.

3. The receiving and pick-up arrangement according to claim 1, wherein the receiving and pick-up arrangement comprises an adjustment device for unfolding and folding up the housing along a vertical axis, wherein the adjustment device adjusts and guides the top wall or the bottom wall of the housing from the folded up state to the unfolded state, and vice versa.

4. The receiving and pick-up arrangement according to claim 1, wherein the receiving and pick-up arrangement comprises a deposit belt, which in the unfolded state extends between the first opening and the second opening and delimits the receiving chamber at the bottom, and a belt drive for driving the deposit belt.

5. The receiving and pick-up arrangement according to claim 1, wherein the receiving and pick-up arrangement comprises a first device for closing and opening the first opening and/or a second device for closing and opening the second opening.

6. The receiving and pick-up arrangement according to claim 1, wherein the housing comprises a base part having the top wall, the bottom wall and the two side walls, and wherein the housing comprises an extension part.

7. The receiving and pick-up arrangement according to claim 6, wherein the receiving and pick-up arrangement comprises a displacement device for axially displacing the extension part relative to the base part, so that the extension part can be displaced parallel to the first hinge axes into a first position, in which the receiving chamber has a first volume, and into at least one second position, in which the receiving chamber has a second volume, which is increased relative to the first volume.

8. The receiving and pick-up arrangement according to claim 6, wherein the extension part comprises a further top wall, a further bottom wall and two further side walls, the two further side walls are each hinged along a third hinge axis to the further top wall and along a fourth hinge axis to the further bottom wall, the two further side walls each have at least two own side wall parts, which are connected in a foldable manner to each other along another folding axis, wherein the third hinge axes and the fourth hinge axes as well as the other folding axes are aligned parallel to each other and thus also parallel to the first hinge axes, the second hinge axes and the folding axes of the base part so that the extension part is foldable.

9. A method for receiving postal items comprising the following steps:

providing the receiving and pick-up arrangement according to claim 1, wherein the housing is arranged in the folded up state;

identifying a postal item located outside the receiving chamber with an electronic component, including at least one of a control unit, a touch display, a key pad, a sensor and a camera;

transferring the housing into the unfolded state;

unlocking of the first opening after successful identification of the postal item;

checking, whether the first opening is closed;

unlocking of the second opening when the first opening is closed; and closing the second opening.

10. A method for pick-up postal items comprising the following steps:

providing the receiving and pick-up arrangement according to claim 1, wherein the housing is arranged in the folded up state;

transferring the housing into the unfolded state;

unlocking of the second opening;

closing the second opening;

identifying a person authorized to pick-up standing in front of the first opening with an electronic component, including at least one of a control unit, a touch display, a key pad, a sensor and a camera;

unlocking of the first opening when the person authorized to pick-up has been successfully identified and the second opening is closed.

* * * * *